US010092110B1

(12) United States Patent
Mohammadi

(10) Patent No.: US 10,092,110 B1
(45) Date of Patent: Oct. 9, 2018

(54) MULTIPLE USES PORTABLE CUSHION

(71) Applicant: Shane S. Mohammadi, Newport Coast, CA (US)

(72) Inventor: Shane S. Mohammadi, Newport Coast, CA (US)

( * ) Notice: Subject to any disclaimer, the term of this patent is extended or adjusted under 35 U.S.C. 154(b) by 0 days.

(21) Appl. No.: 15/700,525

(22) Filed: Sep. 11, 2017

(51) Int. Cl.

| | |
|---|---|
| ***A47C 27/14*** | (2006.01) |
| ***A47C 27/08*** | (2006.01) |
| ***A47C 7/02*** | (2006.01) |
| ***A47C 1/16*** | (2006.01) |
| *A47G 9/00* | (2006.01) |

(52) U.S. Cl.
CPC ..... *A47C 27/14* (2013.01); *A47C 1/16* (2013.01); *A47C 7/021* (2013.01); *A47C 27/081* (2013.01); *A47G 9/00* (2013.01)

(58) Field of Classification Search
CPC ..... A47C 27/14
USPC ..... 5/655.3, 630, 632
See application file for complete search history.

(56) References Cited

U.S. PATENT DOCUMENTS

| | | | | |
|---|---|---|---|---|
| 4,646,374 | A | 3/1987 | Shafer | |
| 5,692,815 | A | 12/1997 | Murphy | |
| D441,587 | S | 5/2001 | Cameron | |
| 6,523,202 | B2 | 2/2003 | Loomos | |
| 6,578,217 | B1 | 6/2003 | Roberson | |
| 6,925,670 | B2 * | 8/2005 | Torrez | A47C 27/00 5/731 |
| 7,007,328 | B1 | 3/2006 | Bailey | |
| 7,171,710 | B2 * | 2/2007 | Mann | A47D 7/03 5/632 |
| 7,305,728 | B2 | 12/2007 | Schliepps | |
| 8,201,889 | B2 | 6/2012 | Montalvo | |
| 8,336,963 | B1 | 12/2012 | Demonaco | |
| 9,049,933 | B2 | 6/2015 | Lavey | |
| 9,216,674 | B1 * | 12/2015 | Garib | B60N 2/441 |
| D772,595 | S | 11/2016 | Waxman | |
| D781,841 | S | 3/2017 | Salathe | |
| 9,717,640 | B1 * | 8/2017 | Pleasants | A61H 1/0292 |
| 2012/0074756 | A1 | 3/2012 | Sayre | |
| 2017/0224118 | A1 | 8/2017 | Fernandez | |

* cited by examiner

*Primary Examiner* — Fredrick C Conley
(74) *Attorney, Agent, or Firm* — Thomas LaGrandeur

(57) ABSTRACT

The present invention relates to a multipurpose cushion formed from a contiguous material having a general shape of a rectangular or oblong base with a triangular portion that rises from a first end of the base toward a second end, the triangular portion covering a majority of the base portion. The cushion may be adapted for any of several uses including upright, vertical placement as an armrest and/or seat divider, or downward vertical placement as a head rest. The cushion may be adapted for applications using a horizontal placement, such as a seat cushion, a laptop device support, a foot rest, and a lumber or neck support for exercise and/or lying down activities. The cushion may further include a belt for use as a belted support in freely moving activities and exercises.

20 Claims, 3 Drawing Sheets

MULTIPLE USES PORTABLE CUSHION

FIELD OF THE INVENTION

The invention relates to a portable cushion device and methods for various bodily and device support, and for separation of space for an individual seat in a row of seating.

BACKGROUND OF THE INVENTION

People spend a considerable amount of time in sitting positions associated with travel, work, and viewing activities where it can be physically beneficial to have a cushion or similar device to provide bodily support and comfort. Likewise, cushions can be used to support people in physical training and exercise activities. Cushions further can be used to provide support for a person and/or helping define personal space when an individual is seated in a seat adjacent to another seat or in-between two seats, for example in airplane travel or viewing activities, such as sporting, theatrical, musical, and movie events. In addition, cushions can be used to provide support for resting a device on a person or holding a device in place for use, such as a portable pad for holding a laptop computer or similar device on a person's lap.

Given the multitude of uses of cushions, pads and the like in the various activities and applications referenced above as well as additional, other activities and applications, people participating in such activities can derive physical benefit from cushions, pads, and the like. People can likewise find increased enjoyment of such activities given support and comfort afforded by cushions, pads and the like while partaking in such activities. Accordingly, there are a wide variety of cushions, pads and the like that are available for providing support and comfort to people engaging in any of numerous activities. Examples of such cushions include those that are sized and shaped as cushions or pads for people to sit on; cushions or pads that are designed to hold devices on a person, such as a laptop computer; cushions or pads that are targeted for training and exercise uses; and cushions or pads designed to provide side, back or foot support or comfort for seated individuals.

Despite the wide variety of cushions, pads, and the like that are typically designed for more specific uses, such cushions and pads can suffer from various drawbacks. Often, various cushions and pads are sized and shaped for a specific use, thereby limiting their utility or application. Likewise, various cushions and pads may be cumbersome in size and/or shape, making them inconvenient to carry from one place or application to another. Accordingly, there remains a need in the art for a portable, multi-use cushion, pad or the like that can advantageously be used to provide support and/or comfort to an individual for multiple activities. The presently described invention provides such a desirable, portable cushion device and methods of using the device.

SUMMARY OF THE INVENTION

Provided herein is a portable cushion or pad device. Preferably, the device is a cushion having a contiguous form that can be regarded as an oblong or rectangular base having a triangular or wedge riser portion that covers between about 60% to about 90% of the base by rising from one end of the base of the pad toward the other end of the pad. Alternatively, the device can be regarded as having a side profile of half of an arrowhead with a rounded tip.

The device is sized and shaped to provide support and comfort to a user in many different applications. Lying flat or horizontal with the base of the device against the base of a seat, on a floor, or on a person's lap, the device respectively can be used as a seat cushion with thigh support; a foot support; and a laptop computer support.

Placed in an upright or vertical position at the edge of a seat such that it will rest beside a seated person, the device can be used as an armrest and seat divider. In this use, the triangular portion angles out toward a seated person to provide an armrest while the upright, base portion that extends beyond the triangular portion provides a barrier that comfortably prevents intrusion on one's arm and elbow from a neighboring seat occupant.

The device can also be used in a vertical position behind a seated person to provide a head and neck rest. In this application, the triangular portion would face down, to provide a cushion that would extend from the back of a person's head down to the base of their neck, at about their shoulder line.

The device may further be used for training support by horizontal placement under the lower back. In this application, the device is placed under the lumbar region of a person on their back to provide support while engaging in leg lifting training and exercise.

The device may similarly be used to support a person's neck while a person is lying down, and viewing a device, book or other object held out in front of the person.

The device also may be used in a wheel chair setting, in which the device may be used in a horizontal position to provide seating support to an individual. The device may likewise be used in an upright position to provide support to a wheel chair occupant's arms, elbows and/or shoulders.

In an alternative embodiment, the device may have a belt that attaches to it, enabling the device to be secured around the torso or abdomen of a person to provide lumbar support during exercise. In this embodiment, the device may be similar to a support belt and provide support for weight lifting, tennis, golf and the like.

The device may be covered with a cover or sleeve that preferably is removable and/or washable.

DETAILED DESCRIPTION OF THE INVENTION

Figure 1:
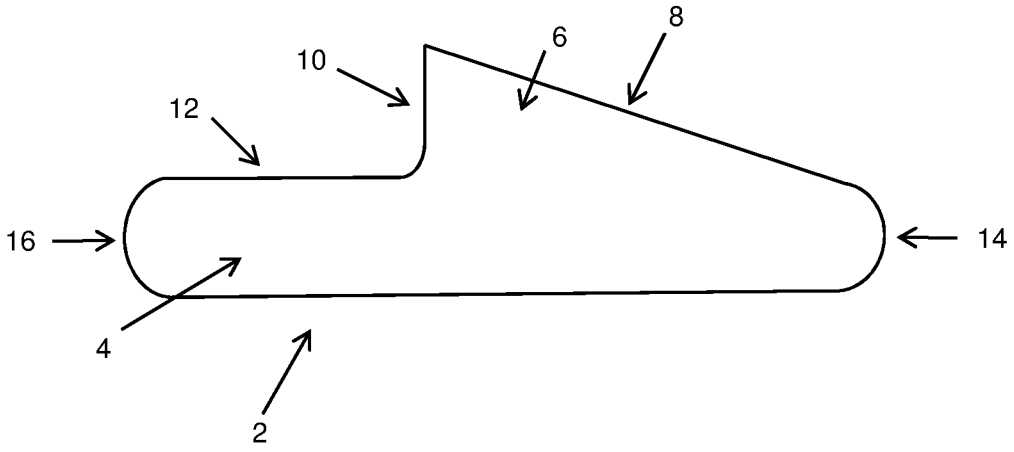
FIG. 1 shows a horizontal, side perspective view of a cushion device.

The present invention relates to a portable, multiple-use cushion or pad device and methods of using the device. The presently disclosed device provides a convenient, portable cushion or pad for several applications as detailed herein to provide support and comfort for a person using the device. In a preferred embodiment, the device has an overall shape or configuration that, when viewed from the side, forms essentially a rectangular or oblong base with a right triangular shaped or wedge portion that rises up across the width of the base and extends upward over approximately two-thirds to three-quarters of the base. The configuration of the device may alternatively be regarded, when viewed from the side, as having a general shape of half of an arrowhead with rounded ends at the tip of the arrowhead and the linear, shaft portion of the arrowhead.

As used herein, the portable cushion, pad, or device is conveniently referred to herein as "a cushion" or "the cushion." A "cushion" as used herein generally refers to a device that may provide support and/or comfort to a user of the cushion. The cushion is formed of a material that may be both soft enough to slightly compress or deform and contour to the shape of the user's body part(s) that contact the cushion while in use and simultaneously firm enough to maintain the cushion's overall shape and provide support to the user's body part(s) that contact the cushion while in use. The cushion may also be firm or rigid enough to allow the cushion to serve as a holder for a device, such as a laptop computer or other similar device, on the user's lap. The cushion accordingly is formed of a slightly compressible material.

In one embodiment, the cushion is made of a foam material, such as, but not limited to, polyurethane foam or viscoelastic polyurethane foam, also known as memory foam. The density and/or hardness of the cushion may vary depending on use and specific application, as described herein. Accordingly, the density and/or hardness of the cushion may range from low, medium, to high for a specific use or application.

Alternatively, the cushion may be constructed to be an air cushion that is inflated during use. In this embodiment, the cushion may therefore have a bladder-type construction that can inflated with air into the final configuration of the cushion from a deflated, flattened configuration. The firmness of the cushion can be adjusted depending on the amount of air inflated into the cushion. In the deflated state, the cushion can readily be stored for storage and/or transportation, whether it be held in a flat configuration or a folded or rolled up configuration.

In a preferred embodiment, the cushion will be covered with a fabric material. The fabric may be selected from any number of applicable fabrics, as known in the art. Such fabrics and materials include, but are not limited, to synthetic fabrics such as polyester, nylon, or blends thereof; cotton; suede; denim; leather; and rubber or rubber-like material. Preferably, the cover will be washable. More preferably, the cover will be form-fitting, removable material that encompasses the inner cushion material. In this embodiment, the cover will be fitted over the inner cushion material and closed with a fastener such as a zipper or fastening means such as hook and loop fasteners, Velcro®, buttons, and the like.

In a preferred embodiment, a cushion as described herein may have dimensions and material in a form of a rectangular or oblong base with a triangular portion that rises up across the width of the base and extends upward over approximately 60% to 90% or more of the base. In a preferred embodiment, a cushion may have base dimensions measuring approximately 11.75 inches long×10 inches wide×1.75 inches thick. The contiguous triangular portion would have the same width of 10 inches, and rise from one end of the base to a height about 2 inches above the base, to give the cushion a maximum height of about 3.75 inches as measured from the bottom of the base to the highest point on the triangular portion. The length of the triangular portion will cover a portion of the base ranging from approximately 60% to 80% to 90% or more of the length of the base, including all variations therein, such that the triangular portion will extend over approximately 7.0 inches to 8.0 inches to 9.0 inches or more over a base portion that is 11.75 inches long, leaving a base portion that extends out approximately 1.75 inches to 4.75 inches from the triangular portion. These dimensions are exemplary and do not limit the size of the cushion in any respect. Accordingly, the size of the cushion may be altered for a specific application, and each of the dimensions may vary plus or minus a range of measurements, including, but not limited to, +/−0.25", 0.5", 0.75", 1", 2", 3", 4" and the like, with the range of measurements containing essentially all variants of sizes from the preferred embodiment of 11.75×10×3.75 inches. Size variations of the cushion may or may not be proportional to the preferred dimensions as described above, so long as the cushion maintains the overall shape or configuration of a contiguous cushion that has a cross-sectional shape of a rectangular or oblong base having a triangular portion thereon. Alternatively, the cross-sectional shape may be regarded as half of an arrow-head having a rounded tip and rounded shaft end.

In a preferred embodiment, a cushion as presently disclosed can be used as seat divider and/or elbow rest. In this embodiment, the cushion is placed at the edge of a person's seat in an upright position, whereby the vertical base rests upright against a seat divider and/or armrest, with the narrow end of the cushion resting against the horizontal seat that a person sits on. The triangular portion of the cushion extends out from the base and rises both upward and toward the body of a seated person to provide an armrest for the seated person. The vertical, upright portion of the base that extends beyond the triangular portion provides a cushioned barrier that allows a seated user to comfortably rest their arm on the cushion while preventing intrusion or touching of the seated user's arm and elbow from an occupant in an adjacent seat. The cushion thereby provides a cushioned, private armrest for a seated user that comfortably supports a user's arm and prevents or shields the user from unwanted intrusion or touching from an arm, elbow or other body part of person seated in an adjacent seat. In this armrest embodiment, the cushion preferably will be made from a foam or similar material that has a medium density and/or hardness to provide both cushioning and support to the user.

In addition to functioning as an armrest, the presently described cushion may also be used in a vertical position as a headrest. In this embodiment, the cushion would be used in an inverted vertical position and placed behind a seated user's head, between the user's head and seat back. The vertical or upright base of the cushion is placed against the seat back, while the triangular portion is placed behind a person's head, such that the triangular portion extends downward from the person's head and extends out from the base toward the person's neck, such that the thickest part of the triangular portion would typically rest against the base of a person's neck and/or their upper shoulder line at the base of the neck. The portion of the base that extends beyond the triangular portion would accordingly rest between the seat back and the seated person's upper back/shoulders. In this configuration as a cushioned headrest, the cushion would typically be constructed of a low to medium density and/or hardness foam or similar material to provide the seated user with cushion and support.

In alternative, preferred embodiments, the presently disclosed cushion can be used in a horizontal configuration for any of several applications that include, but are not limited to, a seat cushion with thigh support, a foot support, and to support a device placed on a person's lap, such as a laptop computer. In the embodiment as a seat cushion, the cushion can be placed in a horizontal position on a person's seat such that the base portion rests against the base of the person's horizontal seat and the triangular portion rises up and under a seated person toward the upper, back portion of the seated person's thigh. The cushion can therefore provide cushion and comfort to a person whose leg or legs extend out and up from a seat while the person is seated. For example, the cushion could be placed on the seat of a person while seated and driving an automobile, thereby providing cushion and support to the back of the seated driver's thighs and/or buttocks. In this application, the cushion would typically be constructed of a foam or similar material having a medium, or medium to high density and hardness including viscoelastic polyurethane foam or "memory foam," which is known to those familiar with the art, to cushion and support the seated person.

In an alternative embodiment, the cushion can be placed in a horizontal position to provide a footrest. In this configuration, the cushion would be placed with its base on a floor, foot well or similar foot resting surface such that the triangular portion rises up and away from a person's leg. The person's foot would thereby rest with the ball of the foot on or near the narrow end of the triangular portion and the toes of the foot resting on the raised, thicker end of the triangular portion. In this use, the triangular portion provides a comfortable and angled support on which a person, especially in a seated position, can rest their foot at a comfortable angle. A cushion used in this manner will typically have a medium or medium to high density and/or hardness foam or similar material to cushion and support a person's foot.

The presently described cushion can likewise be used in a horizontal configuration in an embodiment as a support for a device used on a person's lap, such as a laptop computer. In this embodiment, the base of the cushion can be placed on a seated user's lap, with the triangular portion rising up and away from the person's torso. The cushion thereby provides a cushioned, angled support for comfortably holding and positioning a device on a person's lap. In this embodiment, the cushion will typically have a medium or medium to high density and/or hardness foam or similar material to cushion and support use of a device on a person's lap. The cover of the cushion in this configuration may include a pouch, a slot, a pocket or similar opening for storing an article, such as a laptop computer, a book, and so on. The opening may be one that can be enclosed, including but not limited to a fastening means such as a zipper, a button(s), hook and loop fasteners, Velcro®, and the like. Alternatively, the opening may be enclosed by a flap or similar extension of cover material that folds over or into the opening. In this configuration, the flap can be held in place by a fastening means, such as but not limited to, a zipper, a buckle, a button(s), hook and loop fasteners, Velcro®, and the like.

In yet another embodiment, the cushion may be used in horizontal position to provide support to a person engaged in exercise or training activities. In this embodiment, the cushion may be placed under the lumbar region of a person on their back while the person is engaged in training and exercise that typically involves leg lifting, such as yoga, as well as leg and abdominal muscle development exercises. The base of the cushion is placed on the floor, mat, or similar exercise surface and the triangular portion is placed under a person's back, such that the triangular portion angles upward from the person's lower to upper back. The cushion is shaped to balance the pressure along the natural shape of the lumbar region and provides counter pressure as a person lifts their leg(s), thereby minimizing excessive pressure on the lower back and providing lumbar support. The cushion will typically have a medium or, more preferably, a medium to hard density and/or hardness to provide adequate lumbar support and cushion to a person. As described above, the cushion can be constructed from a foam, memory foam, or similar material.

In a related embodiment, the cushion may be used to support a person's back while a person is lying down and viewing a device, book, or other object held out in front of the person. In this embodiment, the cushion would be placed in a horizontal position under a person's neck, with the base of the cushion lying against the surface on which the person is lying down, and the triangular portion angling up from the person's shoulders toward their upper neck. The cushion thereby can prevent excessive force from being exerted on the neck to provide neck and head support to the person in the lying position. In this configuration, the cushion will typically be constructed from a foam, memory foam or similar material that has a medium density and/or hardness.

The presently described cushion may alternatively be used in a hospice or hospital setting or the like, particularly for a user in a wheel chair. In this embodiment, the cushion could be used in a horizontal configuration to provide support to a seated user's legs, knees, and/or buttocks, for example, by distributing pressure evenly with its triangular/wedge shape. The base of the cushion can be placed on the horizontal seat of a wheel chair, with the triangular/wedge portion rising up, away from the vertical seat back of a wheel chair, thereby providing cushioning and support to a seated user. The cushion could also be used in an upright position to support the weight of a person's arms, elbows, and/or shoulders while seating in a wheel chair. In this manner, the cushion would be placed with the base against the armrest of the wheel chair, and the triangular portion rising up and toward the seated person's body, as described above in the seat divider/armrest configuration. Accordingly, a person in a wheel chair may benefit from one or more cushions arranged in any combination of a horizontal seat support and/or one or more vertical arm, elbow, and/or shoulder supports. Typically, a cushion used in this manner would be constructed from a medium density and/or hardness foam, memory foam or similar material. The cushion would also be covered in high quality, washable fabric cover.

In another embodiment, the presently described cushion may be used to provide lumbar and back support to a person involved in freely moving activities, such as weight lifting, tennis, and golf. In this embodiment, the cushion will have a belt attached to it, whereby the belt can be wrapped around a person's abdominal/stomach region to hold the cushion firmly in place against the lumbar region, similar to a typical weight lifters belt. In this embodiment, the cushion will be belted such that the triangular portion is fitted against a person's back, with the triangular portion angling from the person's lower to upper back, to complement natural back curvature. The base portion will be facing away from the person in this configuration. To provide support in this embodiment, the cushion will be made from a high density and/or hardness foam, memory foam or similar material.

Figure 2A:
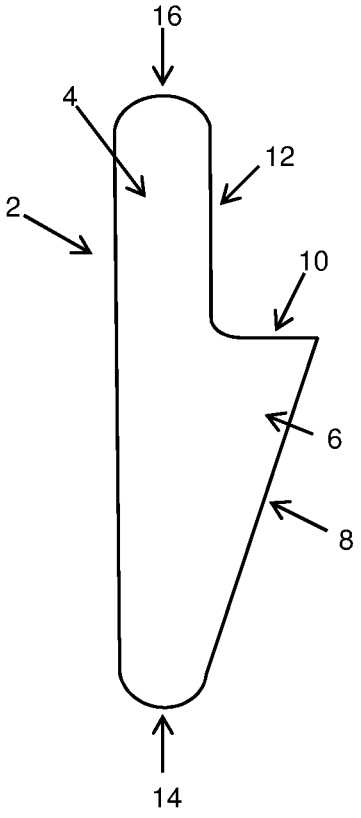
FIG. 2*a* shows a vertical, upright side perspective view of a cushion device.
Figure 2B:
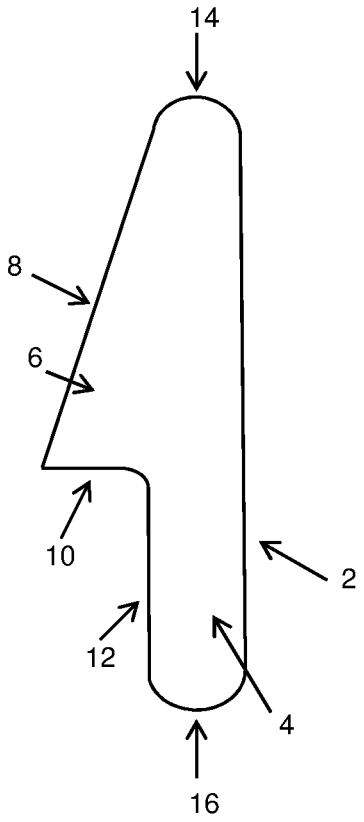
FIG. 2*b* shows a vertical, down facing side perspective view of a cushion device.
Figure 3:
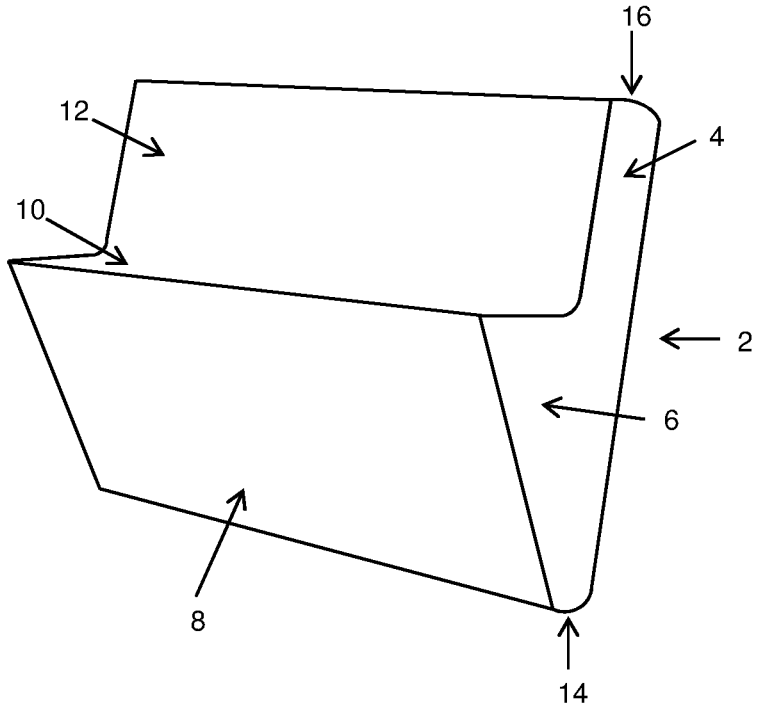
FIG. 3 shows an angled, vertical upright perspective view of a cushion device.

In a preferred embodiment, a cushion as presently disclosed will have a shape with uniform surfaces as shown in FIGS. 1-3. As shown in a cross-sectional view of a horizontal cushion (2) in FIG. 1, the cushion (2) has a rectangular or oblong base portion (4), from which a substantially right triangular shape or wedge portion (6) rises from one end (14) of the base portion (4) to a second end (16) of the base portion (4) to cover approximately 60% to 70% to 80% to 90% or more, with all variations in-between, of the length of the base portion (4), such that approximately 60% to 70% to 80% to 90% or more of the base portion (4) is covered by the triangular portion (6). The triangular portion (6) rises to a height that is approximately equal to the height of the base portion (4), to form a rising or upward face/angled surface (8) on the cushion, and a flat or nearly flat face or surface (10) on the cushion that is perpendicular or nearly perpendicular to the base portion (4). A portion (12) of the base (4) that is not covered by the triangular portion (6) extends away from the flat face (10) of the cushion, such that the flat face (10) is perpendicular or nearly so to the base extension portion (12). The junction between flat face (10) and the base extension portion (12) may be curved or a defined angle, such as perpendicular or nearly so. The overall cross-sectional shape of the cushion (2) is therefore that of a rectangular or oblong base (4) having a contiguous triangular or wedge (6) portion that extends from the base (4) and covers a majority of the length of the base (4). The overall cross-sectional shape of the cushion (2) can alternatively be regarded as a half-arrowhead having a rounded tip (14) at the end of the base (4) from which the triangular portion (6) rises, and a rounded end (16) at the end of the extension portion (12) of the base (4) that forms the arrowhead shaft.

A horizontally placed cushion (2) as shown in FIG. 1 can be used in several of the applications discussed above. For example, without any limitations of use, a horizontal cushion may be used as a seat cushion with thigh support, a foot support, a device or laptop computer support, training/exercise back lumbar support, and neck support while lying down and viewing an object held in front of a person, Cross-sectional views of vertical cushions (2) are show in FIGS. 2*a* and 2*b*. As shown in FIG. 2*a*, a cushion (2) may be placed in vertical, upright position in which the triangular portion (6) rises up and away (8) from the vertical base (4), such that the flat face (10) of the triangular portion (6) faces up. In this configuration, the cushion may be used as an armrest and/or seat divider, as discussed above. The flat face (10) provides a surface for placing a person's elbow or arm on the cushion (2), while the extending portion of the base (12) provides a barrier from intrusion or touching from an occupant in an adjacent seat.

As shown in FIG. 2*b*, a cushion (2) may be place in a vertical, downward position in which the triangular portion (6) angles down and away (8) from the vertical base (4), such that the flat face (10) of the triangular portion faces downward. In this configuration, the cushion may be used as a head rest, as discussed above.

FIG. 3 shows a front, angled view of a cushion (2) in a horizontal, upright position. The base (4) is horizontal, with the triangular portion (6) rising from an end (14) of the base (4) to form a rising or upward face (8) of the cushion from the base 4). The triangular portion (6) is contiguous with the base (4), with both portions having the same width. The triangular portion (6) rises to a height that is approximately equal to the height of the base portion (4), to form an angled, rising or upward face (8) on the cushion. The tallest, topmost edge of the triangular portion (6) drops down to the base to form a flat or nearly flat face (10) that is perpendicular or nearly perpendicular to the base portion (4). The triangular portion covers approximately 60% to 70% to 80% or more of the length of the base and all variations therein. A portion (12) of the base (4) that is not covered by the triangular portion (6) extends away from the flat face (10) of the cushion, such that the junction of the flat face (10) and the base extension portion (12) is perpendicular or nearly so. The unique shape of the presently described cushion provides for its multiple functions and uses, as detailed above.

While the present invention has been described as having particular configurations disclosed herein, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

I claim:

1. A multiuse cushion comprising a single cushion of continuous material having a general shape of a rectangular base portion with a triangular portion covering a majority of the base;

the base and triangular portions having an equivalent width;

the triangular portion having a substantially right triangular shape, the triangular portion rising and extending lengthwise from a first end of the base portion toward a second end of the base portion to form an angled surface that extends out from the base portion with a maximum height toward the second end of the base, the triangular portion covering the base portion at its first end and extending toward the second end of the base portion to cover a majority of the length of the base portion;

wherein the angled surface of the triangular portion has a length that is less than the length of the base portion;

a flat surface formed between the maximum height of the triangular portion and an uncovered base portion not covered by the triangular portion; and the uncovered base portion extending from the flat surface to the second end of the base.

2. The multiuse cushion of claim 1, wherein the triangular portion extends over a majority of the length of the base portion ranging from about 60% to about 90% of the length of the base portion.

3. The multiuse cushion of claim 1, wherein the rectangular base portion has a rounded first end and a rounded second end.

4. The multiuse cushion of claim 1, the cushion further comprising an outer covering that encompasses and closes over the cushion.

5. The multiuse cushion of claim 4, the outer covering further having an article storage opening for storing an article separate from the cushion.

6. The multiuse cushion of claim 5, further comprising a flap that encloses the article storage opening, the flap and the article storage opening having cooperating releasable fasteners for holding the flap in place over the article storage opening.

7. The multiuse cushion of claim 1, the cushion further comprising a removable outer covering that encompasses and closes over the cushion.

8. The multiuse cushion of claim 7, the removable outer covering further having an article storage opening for storing an article separate from the cushion.

9. The multiuse cushion of claim 1, wherein the continuous material is a low density polyurethane foam.

10. The multiuse cushion of claim 1, wherein the continuous material is a medium density polyurethane foam.

11. The multiuse cushion of claim 1, wherein the continuous material is a high density polyurethane foam.

12. The multiuse cushion of claim 1, wherein the continuous material is a viscoelastic polyurethane foam.

13. The multiuse cushion of claim 1, the cushion further comprising a belt.

14. The multiuse cushion of claim 1, wherein the continuous material is a foam.

15. The multiuse cushion of claim 1, wherein the length of the base portion is from 9 to 15 inches long, the width of the base portion is from 9 to 15 inches wide, the triangular portion covers from 60% to 90% of the length of the base portion, the base portion has a height from 1 to 3 inches high, and the maximum height of the triangular portion is from 1 to 3 inches high.

16. The multiuse cushion of claim 1, wherein the length of the base portion is from 11 to 13 inches long, the width of the base portion is from 11 to 13 inches wide, the triangular portion covers from 60% to 90% of the length of the base portion, the base portion has a height from 1.5 to 2.5 inches high, and the maximum height of the triangular portion is from 1.5 to 2.5 inches high.

17. The multiuse cushion of claim 1, wherein the length of the base portion is 11.75 inches long, the width of the base portion is 11.75 inches wide, the triangular portion covers from 60% to 90% of the length of the base portion, the base portion has a height of 2 inches high, and the maximum height of the triangular portion is 1.75 inches high.

18. A seat divider comprising a single cushion of continuous material having a vertical base, an armrest, and a barrier, wherein the cushion has a general shape of a vertical rectangular base portion with a triangular portion covering a majority of the base portion at a first, lower end of the base portion toward a second, upper end of the base portion;

the base and triangular portions having an equivalent width;

the triangular portion having a substantially right triangular shape, the triangular portion rising and extending lengthwise from the first, lower end of the base portion toward the second, upper end of the base portion to form an angled surface that extends out from the base portion with a maximum height toward the second, upper end of the base;

wherein the angled surface of the triangular portion has a length that is less than the length of the base portion;

a flat surface formed between the maximum height of the triangular portion and an uncovered base portion not covered by the triangular portion defining the armrest; and;

the uncovered base portion extending from the flat surface to the second, upper end of the base defining the barrier.

19. The seat divider of claim 18, wherein the flat surface of the cushion armrest formed between the maximum height of the triangular portion and the uncovered base portion is perpendicular to the uncovered base portion.

20. The seat divider of claim 18, the cushion further comprising a removable outer covering that encompasses and closes over the cushion.

* * * * *